US008561846B2

(12) United States Patent
Hauner et al.

(10) Patent No.: US 8,561,846 B2
(45) Date of Patent: Oct. 22, 2013

(54) TAP ASSEMBLY

(75) Inventors: David R. Hauner, Salem, WI (US); Andrew N. Wrigley, Auckland (NZ); Yeong Heng Koo, Auckland (NZ)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/505,319

(22) PCT Filed: Nov. 1, 2010

(86) PCT No.: PCT/US2010/054973

§ 371 (c)(1), (2), (4) Date: May 1, 2012

(87) PCT Pub. No.: WO2011/162788

PCT Pub. Date: Dec. 29, 2011

(65) Prior Publication Data

US 2012/0211519 A1 Aug. 23, 2012

Related U.S. Application Data

(60) Provisional application No. 61/257,297, filed on Nov. 2, 2009.

(51) Int. Cl.
*B67B 1/00* (2006.01)

(52) U.S. Cl.
USPC ..... 222/153.01; 222/153.06; 222/153.07; 222/153.13; 222/153.14

(58) Field of Classification Search
USPC ..... 222/81, 83, 541.6, 451.9, 153.01, 222/153.05, 153.06, 153.07, 153.1, 153.13, 222/153.14, 511, 513–14, 518
See application file for complete search history.

(56) References Cited

U.S. PATENT DOCUMENTS 4,469,249 A * 9/1984 Malpas et al. ..... 222/83
4,570,826 A * 2/1986 Fattori ..... 222/83

(Continued)

FOREIGN PATENT DOCUMENTS

EP 0043698 A1 1/1982
EP 0148971 A2 7/1985
EP 0304972 A1 3/1989
FR 2619612 A1 2/1989
GB 2082152 A * 3/1982

(Continued)

OTHER PUBLICATIONS

ISR for PCT/US2010/054973 dated Feb. 2, 2011.

*Primary Examiner* — Paul R Durand
*Assistant Examiner* — Benjamin R Shaw
(74) *Attorney, Agent, or Firm* — Mark W. Croll; Paul F. Donovan

(57) ABSTRACT

Tap assembly configured to resist release of the tap when an internal vacuum is applied to the tap and to maintain aseptic conditions of fluid within an attached fluid container before first use of the tap. The tap assembly having an actuation member configured to cover at least a portion of a bore within a body; a cover configured to substantially enclose and abut a proximal portion of the actuation member to prevent actuation of the actuation member by engaging with the body; and a piercer element positioned on an end of the actuation member proximal to a sterility membrane sealed over the bore and including at least one projection to pierce the sterility membrane when the actuation member is actuated during first use of the tap assembly.

17 Claims, 8 Drawing Sheets

(56) References Cited

U.S. PATENT DOCUMENTS

| | | | | | |
|---|---|---|---|---|---|
| 4,624,392 | A * | 11/1986 | Malpas et al. | ..... | 222/83 |
| 4,722,458 | A * | 2/1988 | Van Dal | ..... | 222/105 |
| 4,884,705 | A * | 12/1989 | Debetencourt | ..... | 215/250 |
| 5,482,176 | A * | 1/1996 | Maietta et al. | ..... | 220/277 |
| 7,789,269 | B2 * | 9/2010 | Pritchard | ..... | 222/81 |
| 2008/0283790 | A1 * | 11/2008 | Wrigley et al. | ..... | 251/366 |

FOREIGN PATENT DOCUMENTS

| | | | |
|---|---|---|---|
| WO | WO 8102418 | A1 * | 9/1981 |
| WO | 2007054797 | A1 | 5/2007 |
| WO | WO 2007054797 | A1 * | 5/2007 |

* cited by examiner

Figures 3A-D

TAP ASSEMBLY

CROSS REFERENCES TO RELATED APPLICATIONS

The present application is national phase of PCT/US2010/054973 filed Nov. 1, 2010, based on the provisional specification filed on Nov. 2, 2009 in relation to U.S. Patent Application No. 61/257,297.

BACKGROUND TO THE INVENTION

A disadvantage with known fluid dispensing taps (such as that disclosed in WO2007054797) is release of the tap due to a pressure differential between the inside of the tap attached to a fluid container and the outside atmospheric pressure. Sterility of manufactured taps (for use in the storage and dispensing of sterile fluids such as fruit juices) is obtained during the tap manufacture using processes such as steam autoclaving at temperatures above 100° C. Such treatment can frequently result in an internal vacuum being created. This can result in inadvertent actuation of the tap and unwanted and potentially hazardous spillage of fluid from the tap. One solution to this problem is to increase the force required to release the tap by the user by increasing tolerances between a tap body and an actuation member of the tap or by biasing actuation of the tap. However this can be inconvenient or potentially hazardous to the user.

A further disadvantage with known taps is the risk of reaction of oxygen sensitive fluids, such as wine, with oxygen during transportation and/or storage of fluid within the fluid container to which the tap is attached before use of the tap. Such reaction can spoil the fluid and reduce shelf-life.

One solution to this problem is purging of the tap and contents of the container to which the tap is attached with nitrogen to reduce the oxygen content of the stored fluid to a level lower than normal air levels (approximately 21%) to reduce the efficiency of aerobic microbial growth. However such treatment can be expensive.

It is an object of the present invention to address the foregoing problems or at least to provide the public with a useful choice.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

SUMMARY OF THE INVENTION

According to one aspect of the present invention there is provided a tap assembly, comprising:

a body having a bore formed therein;

an actuation member configured to cover at least a portion of the bore;

a cover configured to substantially enclose and abut a proximal portion of the actuation member wherein the cover prevents actuation of the actuation member by engaging with at least one first engagement portion formed on the body;

a sterility membrane sealingly positioned over an end of the bore; and a piercer configured to pierce the sterility membrane when the actuation member is actuated for the first time.

Preferably, the cover comprises a tamper evident indicator comprising a removable portion attached to the cover at at least one weakened join.

More preferably, the removable cover also comprises a pull-tab.

In this way the cover portion is configured to separate the removable portion of the cover from the body to expose the actuation member when a user breaks the at least one weakened join via the pull-tab.

Preferably, the actuation member comprises a button.

Preferably, the first engagement portion is a lip formed on the body which is configured to engage with a corresponding groove formed in the cover.

More preferably, the cover comprises a second engagement portion in the form of a groove formed in the actuation member which is configured to engage with a corresponding lip formed on the cover.

More preferably, the cover also comprises an annular band to sealingly engage with the body of the tap assembly after engagement of the annular bead with the engagement portion.

In this way the internal spaces between the cover and the actuation member and between the actuation member and the body are kept under aseptic conditions.

More preferably, the tap assembly also comprises at least one projection positioned on an end of the actuation member proximal to the sterility membrane.

In this way actuation of the actuation member causes the projection to pierce the sterility membrane to facilitate the flow of fluid between the fluid container and the tap assembly.

Preferably, the at least one projection is 3 to 5 projections.

More preferably, one of the projections is positioned proximal of the other projections with respect to the sterility membrane.

In this way, the proximal projection provides an initial point of entry into the sterility membrane and minimises the force required to pierce the sterility membrane.

Preferably, the at least one projection comprises at least one fluid passageway to facilitate the flow of fluid between the bore and the tap assembly after entry of the at least one projection into the sterility membrane.

Preferably, the at least one projection comprises at least one serration configured to maintain the projection in place relative to the sterility membrane after entry of the projection into the sterility membrane.

Preferably, the at least one projection is configured to pull away the cut sterility membrane from the intended fluid flow path after withdrawal of the at least one projection from the sterility membrane.

According to another aspect of the present invention there is provided a tap assembly, comprising:

a body having a bore formed therein;

an actuation member configured to cover at least a portion of the bore;

a cover configured to substantially enclose and abut a proximal portion of the actuation member wherein the cover prevents actuation of the actuation member by engaging with at least one first engagement portion formed on the body and wherein the cover also comprises a tamper evident indicator comprising a removable portion attached to the cover at at least one weakened join;

a sterility membrane sealingly positioned over an end of the bore; and a piercer configured to pierce the sterility membrane when the actuation member is actuated for the first time.

According to another aspect of the present invention there is provided tap assembly, comprising:

a body having a bore formed therein;

an actuation member configured to cover at least a portion of the bore;

a cover configured to substantially enclose and abut a proximal portion of the actuation member wherein the cover prevents actuation of the actuation member by engaging with at least one first engagement portion formed on the body and wherein the cover also comprises a tamper evident indicator comprising a removable portion attached to the cover at at least one weakened join;

a sterility membrane sealingly positioned over an end of the bore; and a piercer configured to pierce the sterility membrane when the actuation member is actuated for the first time wherein the piercer comprises at least one projection positioned on an end of the actuation member proximal to the sterility membrane and wherein the at least one projection comprises at least one fluid passageway to facilitate a flow of fluid within the bore and from the tap assembly after entry of the at least one projection into the sterility membrane.

BRIEF DESCRIPTION OF DRAWINGS

Further aspects of the present invention will become apparent from the following description which is given by way of example only and with reference to the accompanying figures in which.

DETAILED DESCRIPTION OF THE INVENTION

Figure 1:
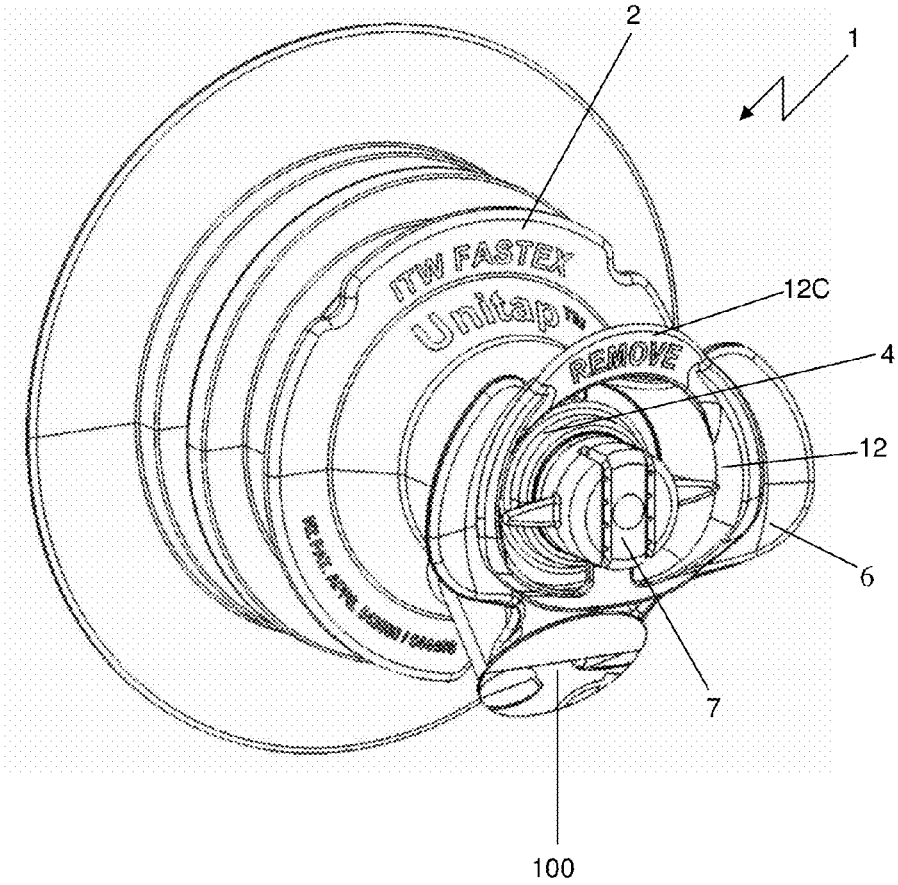
FIG. 1 shows a perspective view of a preferred embodiment of the present invention in the form of a tap assembly.
Figure 2:
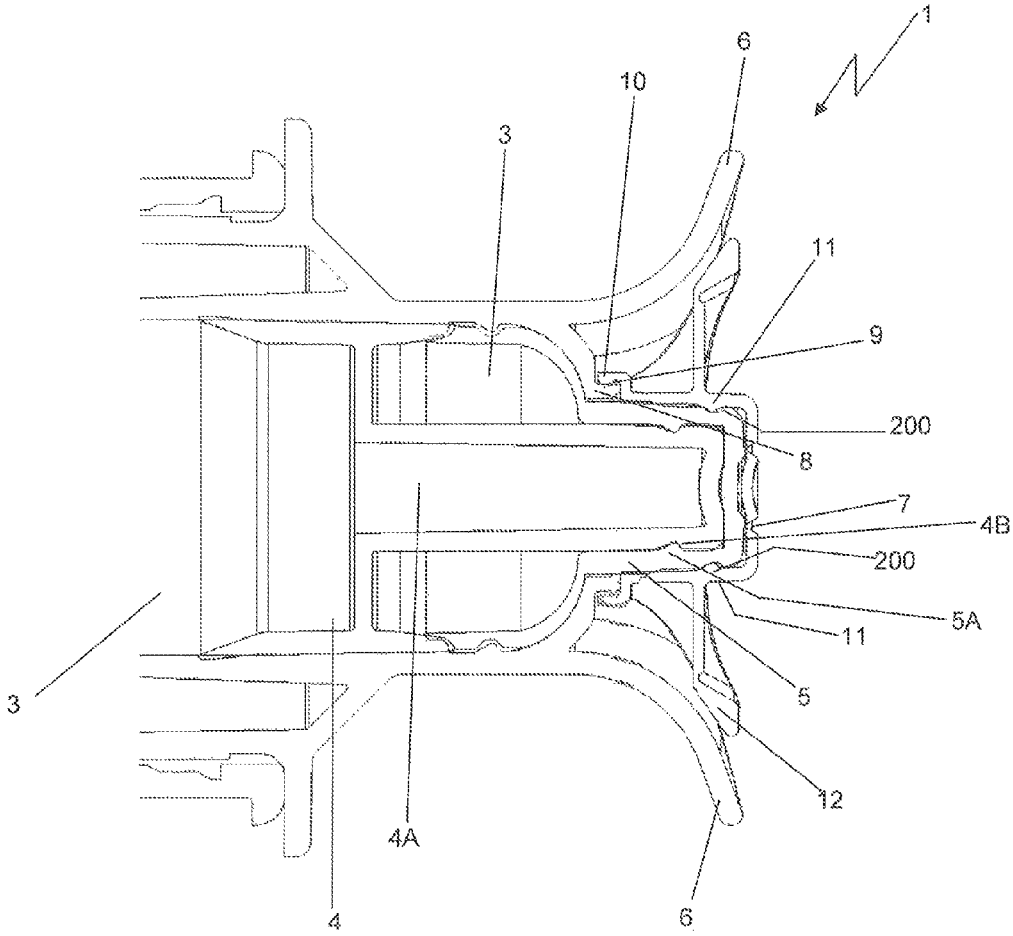
FIG. 2 shows a side section view of the embodiment shown in FIG. 1.

Referring to FIGS. 1 and 2, a preferred form of the invention in the form of a tap assembly generally indicated by arrow 1. The tap assembly 1 comprises a body 2 having a bore 3 formed therein (best seen in FIG. 2) for flowable material such as fluids to flow through the tap assembly 1 from a connected fluid container (not shown) and exit the body 2 at an outlet 100 (as shown in FIG. 1). Typically the body 2 is formed in a plastics material by injection moulding. The tap assembly 1 also comprises an actuation member in the form of button 4A on the end of a push rod 4 to control movement of the push rod 4 which is configured to cover the bore 3 and thereby control the flow of fluid through the outlet 100. The button 4A is connected to the body 2 at seal 5 (as shown in FIG. 2) via a second engagement portion in the form of annular groove 4B on button 4A engaging with corresponding annular bead 5A on seal 5. In this way aseptic conditions are maintained inside the tap assembly 1 during actuation of the button 4A.

A pair of wing-like projections 6 extends from the body 2 near the button 4A to provide convenient surfaces, transverse to the body, for an operator to grip with their index and middle fingers while depressing the button 4A with their thumb.

The tap assembly 1 also comprises a cover in the form of a cap 7 which encloses and abuts the button 4A to prevent actuation of the button 4A. Cap 7 is fitted by clip-fit engagement with annular lip 8 on body 2. The cap 7 attaches to a first engagement portion in the form of lip 8 of the body 2 at groove 9 (best seen in FIG. 3D) which aseptically seals to the body 2 via a seal surface 10. In this way actuation of the button 4A is prevented by an internal pressure differential, such as a vacuum within the tap assembly 1. In addition the cap 7 connects to the upper periphery of the button 4A by clip-fit engagement of annular bead 11 with retainer groove 200 of cap 7 which retains the button-valve 4A with respect to the cap 7.

Figure 3:
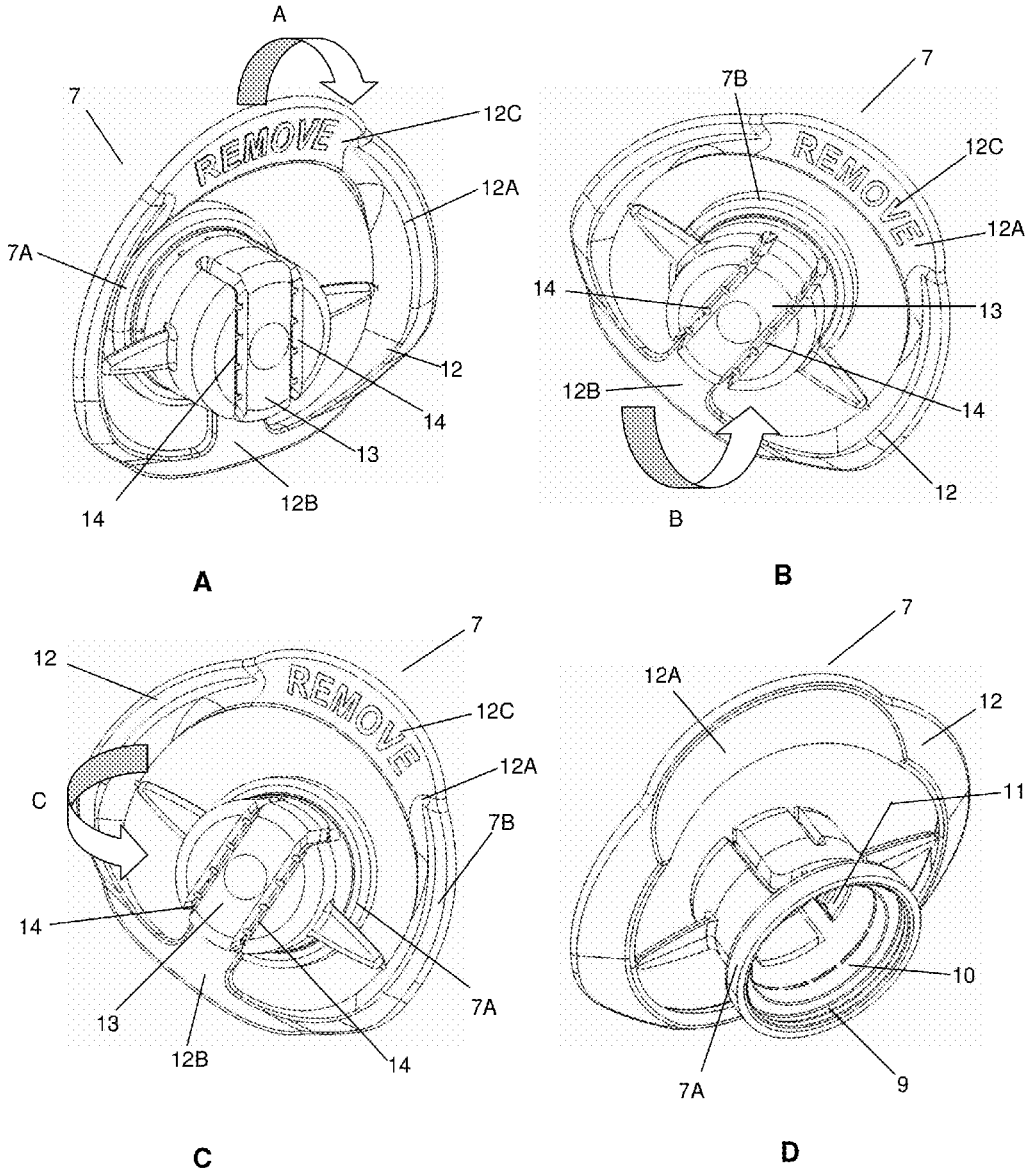
FIGS. 3A-D show perspective views of the method of operation of the cover of the embodiment shown in FIG. 1.
Figure 4:
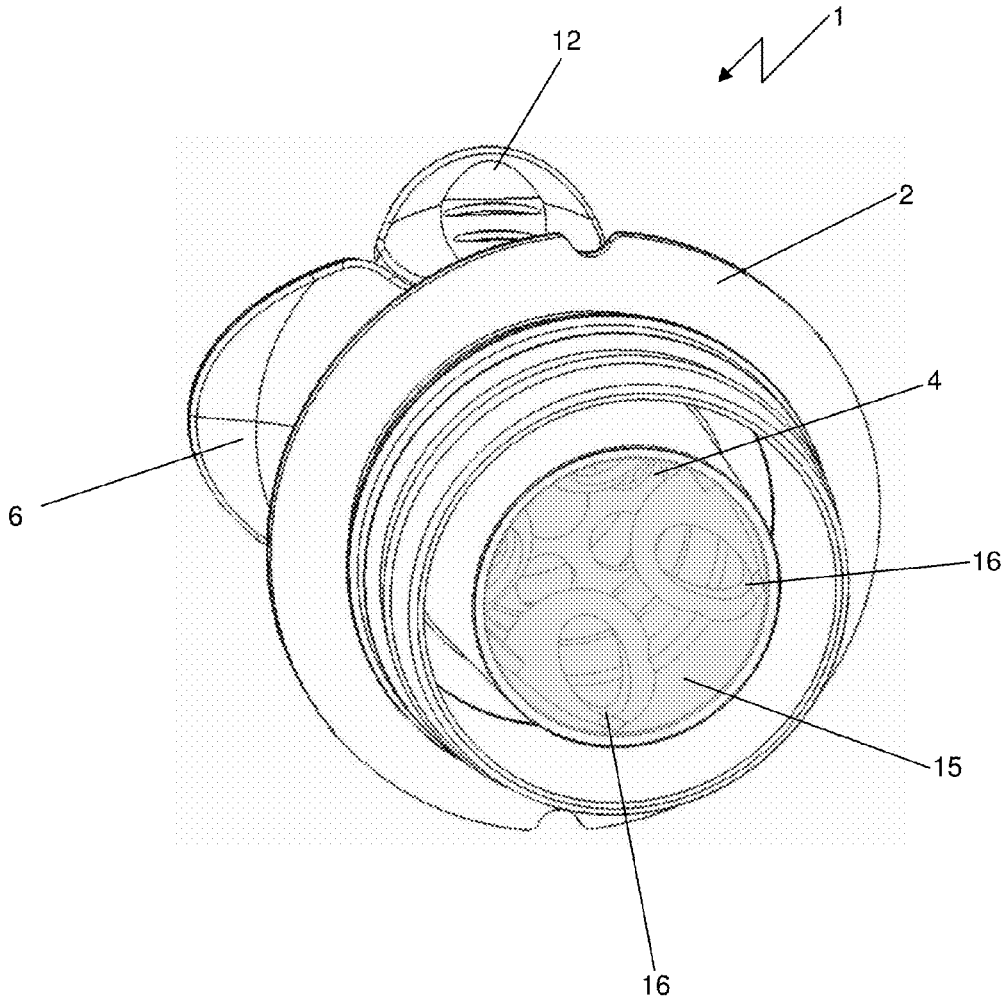
FIG. 4 show a perspective view of the rear end of the embodiment shown in FIG. 1 with projections held within the body of the tap.
Figure 5:
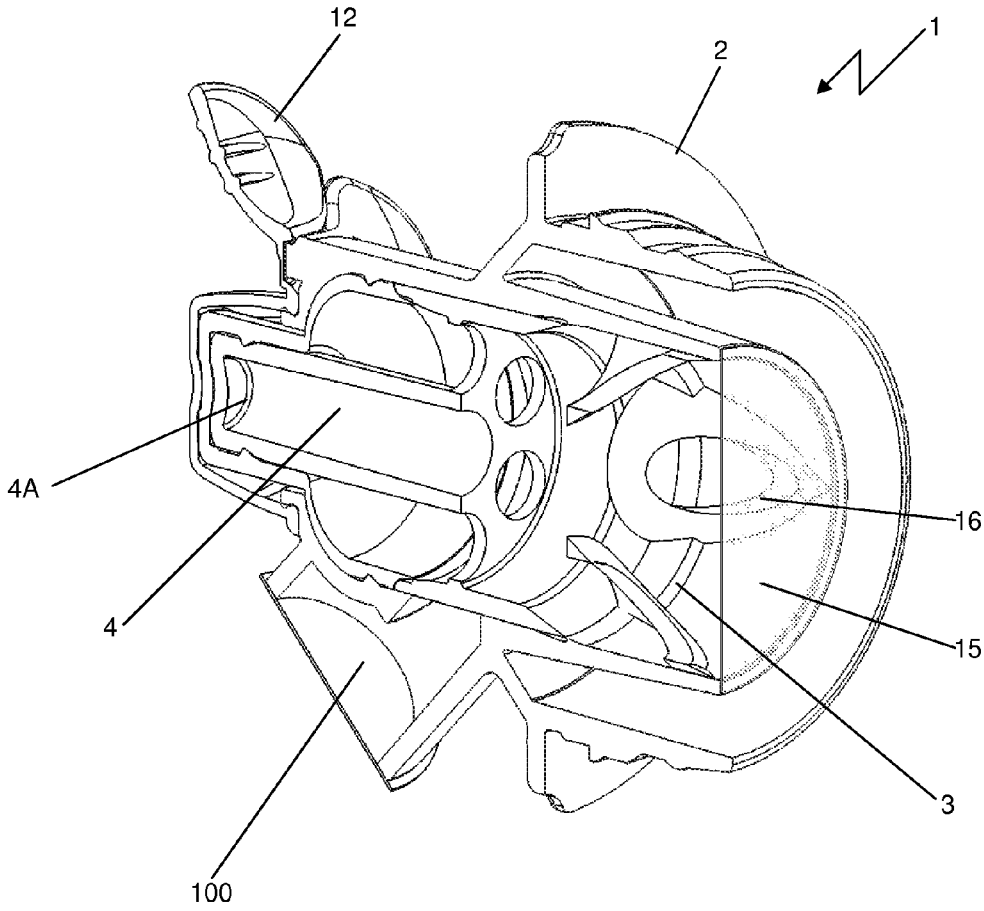
FIG. 5 shows a sectional perspective view of the embodiment shown in FIG. 4.

The cap 7 has a pull tab 12 to facilitate a user gripping the cap 7 (best seen in FIGS. 3A-D). In the preferred embodiment shown the pull-tab 12 comprising ring 12A connected to the cap 7 at lug 12B (as shown in FIGS. 3A to 3C). Indicative markings 12C on the pull-tab 12 indicate the need to remove the cap 7 before operation of the tap assembly 1. The pull tab 12 is connected to cap 7 via breakaway flap 13. The breakaway flap 13 is connected to the rest of the cap 7 by two weakened joins 14 extending substantially the profile of the cap 7 but ending proximal to the base 7A of the cap 7 (best seen in FIG. 3A).

FIGS. 3A to C show the method of removal of the cap 7 from the body 2 of the tap assembly 1. In use a user 500 grips the ring 12A of the pull-tab 12 and pulls forward and away from the container (not shown) in the direction of arrow A (as shown in FIGS. 3A). The pull-tab 12 (and connected breakaway flap 13) is then pulled upward to tear the weakened joins 14 (as shown in FIG. 3B). As the pull-tab 12 is pulled further upwards in the direction of arrow C the breakaway flap 13 continues to tear away from the remainder of the cap 7 at the weakened joins 14 (as shown in FIGS. 3C). The cap 7 then is pulled away from the body 3 of the tap assembly 1 in one piece which removes the breakaway flap 13 from part of the periphery of the cap 7 and allows the cap 7 to flex as required to remove bead 11 from groove 200 on button 4A. In this way the cap 7 provides a tamper evident feature to a user.

As shown in FIGS. 4 to 7 the tap assembly 1 may also comprises a pierce-able sterility membrane 15 attached over the end of the bore 3. The sterility membrane 15 may be made of any suitable material which provides a barrier to the exchange of fluids between a fluid container (not shown) and the bore 3 (which improves the quality of oxygen sensitive fluids such as wine to improve the shelf life of the fluid during transport and storage and before use of the fluid container, such as a "bag-in-the box"), and is attached to the end of the bore 3 by any suitable process known to those skilled in the art, such as heat sealing. Such a sterility membrane 15 can also provide a further barrier to microorganisms.

If a sterility membrane is used, the push-rod 4 of the tap assembly 1 also incorporates three projections 16 positioned on an end of the push-rod 4 and proximal to the sterility membrane 15. Actuation of the push-rod 4 via the button 4A causes piercing of the sterility membrane 15 by the projections 16 and resultant flow of fluid from the attached fluid container (not shown) once the projections 16 are withdrawn by release of the button 4.

Figure 6:
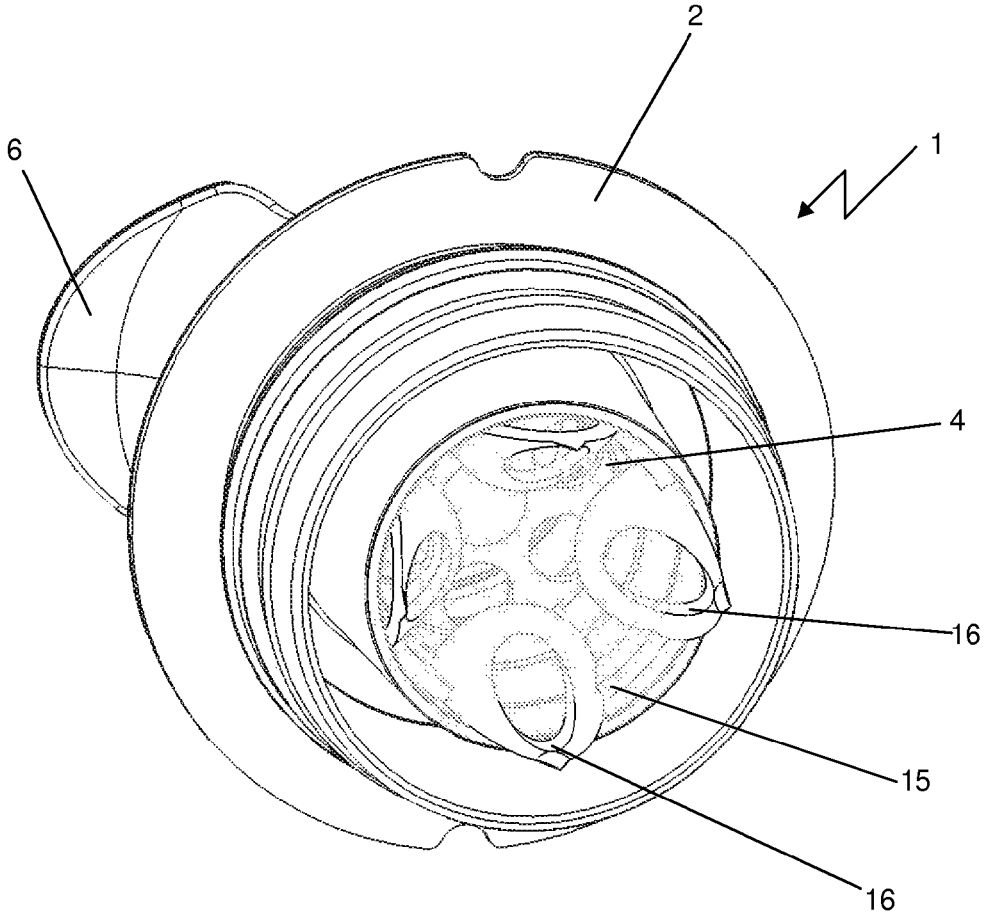
FIG. 6 shows a perspective view of the rear end of the embodiment shown in FIG. 4 with projections extending through a pierced sterility membrane.
Figure 7:
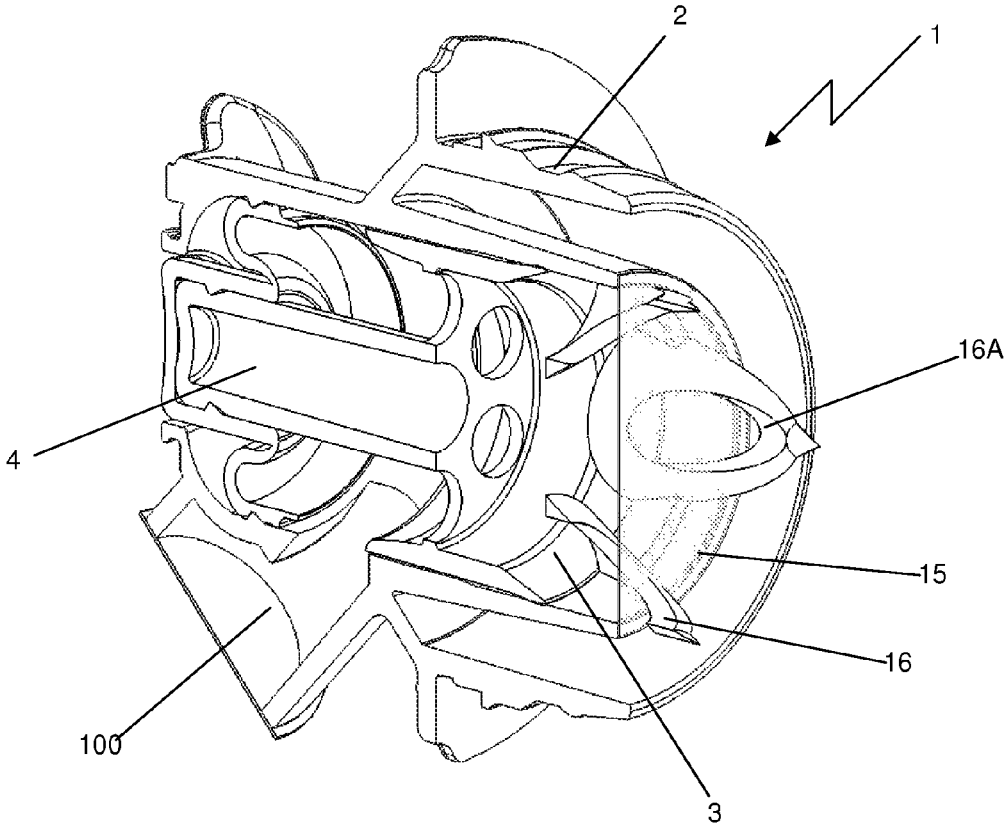
FIG. 7 shows a sectional perspective view of the embodiment shown in FIG. 6.
Figure 8:
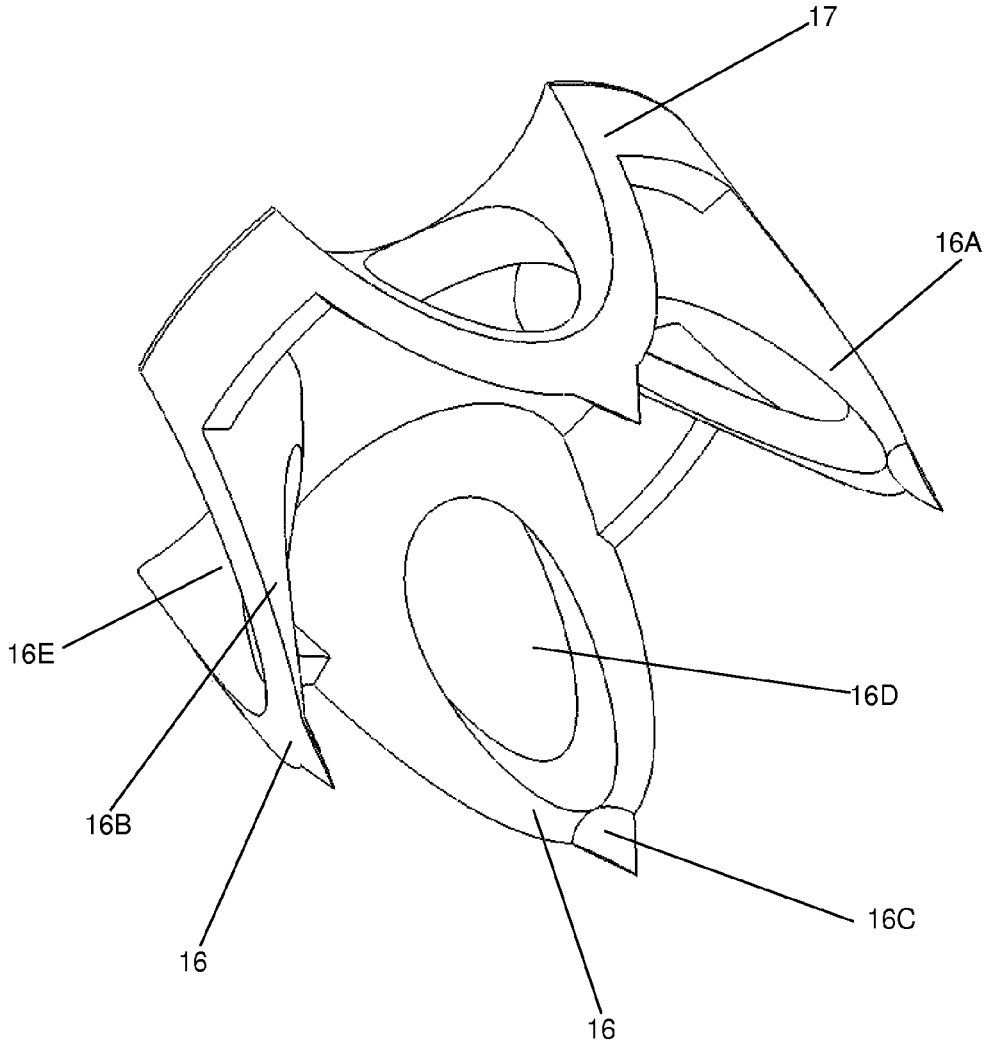
FIG. 8 shows a perspective view of a preferred embodiment of the projections shown in FIG. 4.

Optionally one of the projections (16A in FIGS. 8 and 9) is positioned forward of the other projections 16 with the result that actuation of the push-rod 4 causes piercing of the sterility membrane 15 by the projection 16A first (as shown in FIGS. 6 and 7). In this way, projection 16A provides an initial point of entry into the sterility membrane 15 and minimises the force required to pierce the sterility membrane 15 by the push-rod 4.

A person skilled in the art will appreciate that the shape of the projections 16 may be varied without departing from the scope of the present invention. Each projection 16 comprises a shear wall 16A, a tapered surface 16B, a piercing point 16C and an aperture 16D (best seen in FIG. 8). The combination of these features function as fluid entry ports 16E for fluid flow after the projections 16 have pierced the sterility membrane 15. This shape prevents occlusion of the side entry ports 16E by flaps of the sterility membrane 15 after piercing. In addition, the shape of the projections is configured to pull away the cut sterility membrane 15 from the intended fluid flow path in the bore 3 in the event of withdrawal of the projections 16 from the pierced sterility membrane 15.

The base 17 may be connected to the push-rod 4 or may form an extension of the push-rod 4. Each projection can optionally include at least one serration (not shown) configured to maintain the projections 16 in place relative to the sterility membrane 15 after entry of the projections 16 into the sterility membrane 15 which aids in the cutting efficiency of the projections 16.

Thus preferred embodiments of the present invention have a number of advantages over the prior art which include:

improved security of inadvertent release of the tap;
improved storage of oxygen sensitive fluids;
improved aseptic capability; and
tamper proof indication.

Aspects of the present invention have been described by way of example only and it should be appreciated that modifications and additions may be made thereto without departing from the scope thereof as defined in the appended claims.

What is claimed is:

1. A tap assembly, comprising:

a body comprising a bore formed therein and a first engagement portion;

an actuation member configured to cover at least a portion of the bore; and a cover configured to substantially enclose and abut a proximal portion of the actuation member and comprising a second engagement portion configured to engage with the first engagement portion to prevent movement of the cover with respect to the body;

wherein the proximal portion of the actuation member comprises a first retention portion and the cover also comprises a second retention portion positioned on an interior surface of the cover and configured to engage with the first retention portion to prevent movement of the actuation member with respect to the cover.

2. A tap assembly as claimed in claim 1 wherein the first engagement portion is an annular lip.

3. A tap assembly as claimed in claim 2 wherein the second engagement portion is an annular groove.

4. A tap assembly as claimed in claim 1 wherein the first engagement portion comprises a sealing surface configured to aseptically seal from fluid loss between the body and the actuation member.

5. A tap assembly as claimed in claim 1 wherein the proximal portion of the actuation member is a button.

6. A tap assembly as claimed in claim 1 wherein the first retention portion is an annular groove.

7. A tap assembly as claimed in claim 6 wherein the second retention portion is an annular lip configured to engage with the annular groove formed on the actuation member.

8. A tap assembly as claimed in claim 1 wherein the cover also comprises a tamper evident indicator comprising a removable portion attached to the cover at at least one weakened area.

9. A tap assembly as claimed in claim 8 wherein the removable portion comprises a pull-tab.

10. A tap assembly as claimed in claim 1 wherein the tap assembly also comprises a sterility membrane configured to seal the end of the bore to prevent inadvertent loss of fluid from the bore before first use of the tap assembly.

11. A tap assembly as claimed in claim 10 wherein the tap assembly also comprises a piercer configured to pierce the sterility membrane when the actuation member is actuated for the first time.

12. A tap assembly as claimed in claim 11 wherein the piercer comprises at least one projection positioned on an end of the actuation member proximal to the sterility membrane.

13. A tap assembly as claimed in claim 12 wherein the at least one projection is 3 to 5 projections.

14. A tap assembly as claimed in claim 13 wherein one of the projections is positioned proximal of the other projections with respect to the sterility membrane.

15. A tap assembly as claimed in claim 12 wherein the at least one projection comprises at least one fluid passageway to facilitate the flow of fluid between the bore and the tap assembly after entry of the at least one projection into the sterility membrane.

16. A tap assembly as claimed in claim 15 wherein the at least one projection comprises at least one serration configured to maintain the projection in place relative to the sterility membrane after entry of the projection into the sterility membrane.

17. A tap assembly as claimed in claim 12 wherein the at least one projection is configured to pull away the cut sterility membrane from the intended fluid flow path after withdrawal of the at least one projection from the sterility membrane.

* * * * *